United States Patent [19]

Fink

[11] Patent Number: 4,854,223

[45] Date of Patent: Aug. 8, 1989

[54] PNEUMATIC OR HYDRAULIC DRIVE FOR OPENING AND CLOSING OF DOORS

[75] Inventor: Martin Fink, Waidhofen a.d. Ybbs, Austria

[73] Assignee: IFE Industrie-Einrichtungen Fertigungs-Aktiengesellschaft, Austria

[21] Appl. No.: 103,549

[22] PCT Filed: Jan. 20, 1987

[86] PCT No.: PCT/AT87/00002

§ 371 Date: Nov. 9, 1987

§ 102(e) Date: Nov. 9, 1987

[87] PCT Pub. No.: WO87/04483

PCT Pub. Date: Jul. 30, 1987

[30] Foreign Application Priority Data

Jan. 20, 1986 [AT] Austria ..... A125/86

[51] Int. Cl.[4] ..... F15B 15/26; E05F 15/00

[52] U.S. Cl. ..... 92/17; 92/24; 92/25; 92/27; 92/21 MR; 92/116; 91/45; 74/2; 74/529; 49/280

[58] Field of Search ..... 91/41, 43, 45; 92/21 R, 92/21 MR, 15, 24, 116, 25, 27, 28, 17, 29, 138, 14, 19, 140; 74/2, 529, 99 A, 99 R; 49/139, 140, 322, 334, 337, 340, 280

[56] References Cited

U.S. PATENT DOCUMENTS

| | | | |
|---|---|---|---|
| 720,399 | 2/1903 | Brewer | 91/41 |
| 1,002,596 | 9/1911 | McElroy | 91/41 |
| 1,098,585 | 6/1914 | Mills | 91/41 |
| 2,932,282 | 4/1960 | McKinley | 91/45 |
| 4,185,539 | 1/1980 | Stratienko | 91/45 |
| 4,545,149 | 10/1985 | Jentsch | 42/280 |
| 4,731,886 | 3/1988 | Heinrich et al. | 74/99 R |

*Primary Examiner*—Robert E. Garrett
*Assistant Examiner*—Thomas Denion
*Attorney, Agent, or Firm*—Toren, McGeady & Associates

[57] ABSTRACT

The invention is directed to a penumatic or hydraulic drive for opening and closing of doors, in which the linear motion of a double-acting piston 5 driven by a pressure medium is converted into a rotary motion of a spindle 2 through a piston rod 6 and a helical gear box 3. Herein a blocking lever 10 supported in a stationary manner is provided, which in the closed position of the door engages under the action of a spring 18 at a part 11 connected with a piston 5, wherein said blocking lever secures the piston in its end position and is held in its open position counter to the force of an additional spring 15 by a power cylinder 14 acted upon by the pressure means.

3 Claims, 3 Drawing Sheets

PNEUMATIC OR HYDRAULIC DRIVE FOR OPENING AND CLOSING OF DOORS

Figure 1:
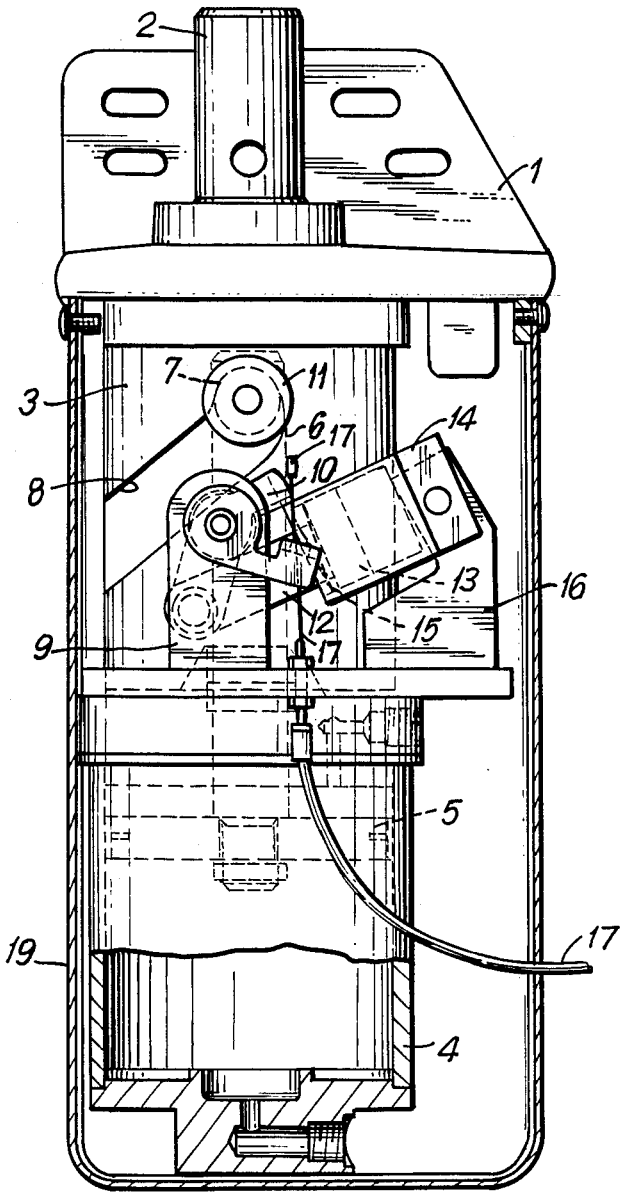

The invention is directed to a pneumatic or hydraulic drive for opening and closing of doors, in which the linear motion of a double-acting piston driven by a pressure medium is converted by means of a piston rod and a helical gear box into rotational motion of a spindle.

The disadvantage in the known rotary drives of this sort is that in case of pressure loss of the working medium the double-acting piston moves downwards and the door can open. Herein there arises the danger that the door yields under a force in the sense of opening of the door and thus persons are endangered. If the leakage arises during a period when the vehicle is parked, access of unauthorized persons inside the vehicle is possible.

The invention aims at creating an arrangement, which blocks the opening motion of the door in case of pressure loss. This is achieved in the invention in that a stationarily supported blocking lever is provided which in the closed position of the door engages under spring action at a part connected with the piston, wherein said blocking lever secures the piston in its end position and is held in its open position counter to the force of another spring by means of a power cylinder acted upon by a pressure medium.

Since the blockage has to be removed in order to be able to open the door, it is provided in a refinement of the invention that the blocking lever is connected with a manually operated Bowden cable.

A particularly advantageous embodiment results if the Bowden cable emanates from a hand lever, which can actuate a three-way cock in the pressure line of the pressure medium, which in the one end position of the hand lever connects the pressure medium line with the return flow. This creates an emergency actuation arrangement.

The subject of the invention is depicted in the drawing in an embodiment form by way of an example.

Figure 2:
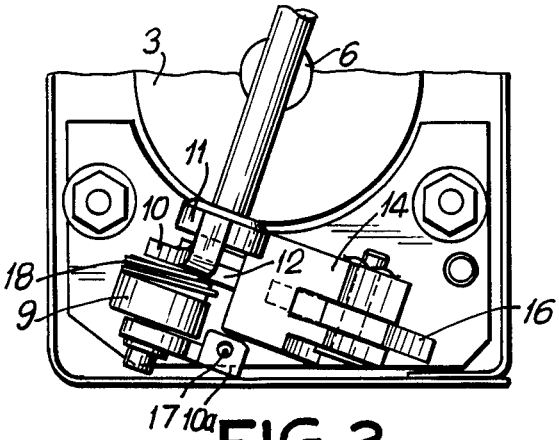
Figure 3:
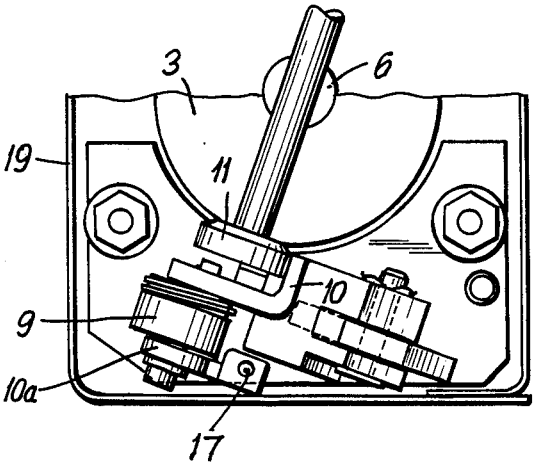
Figure 4:
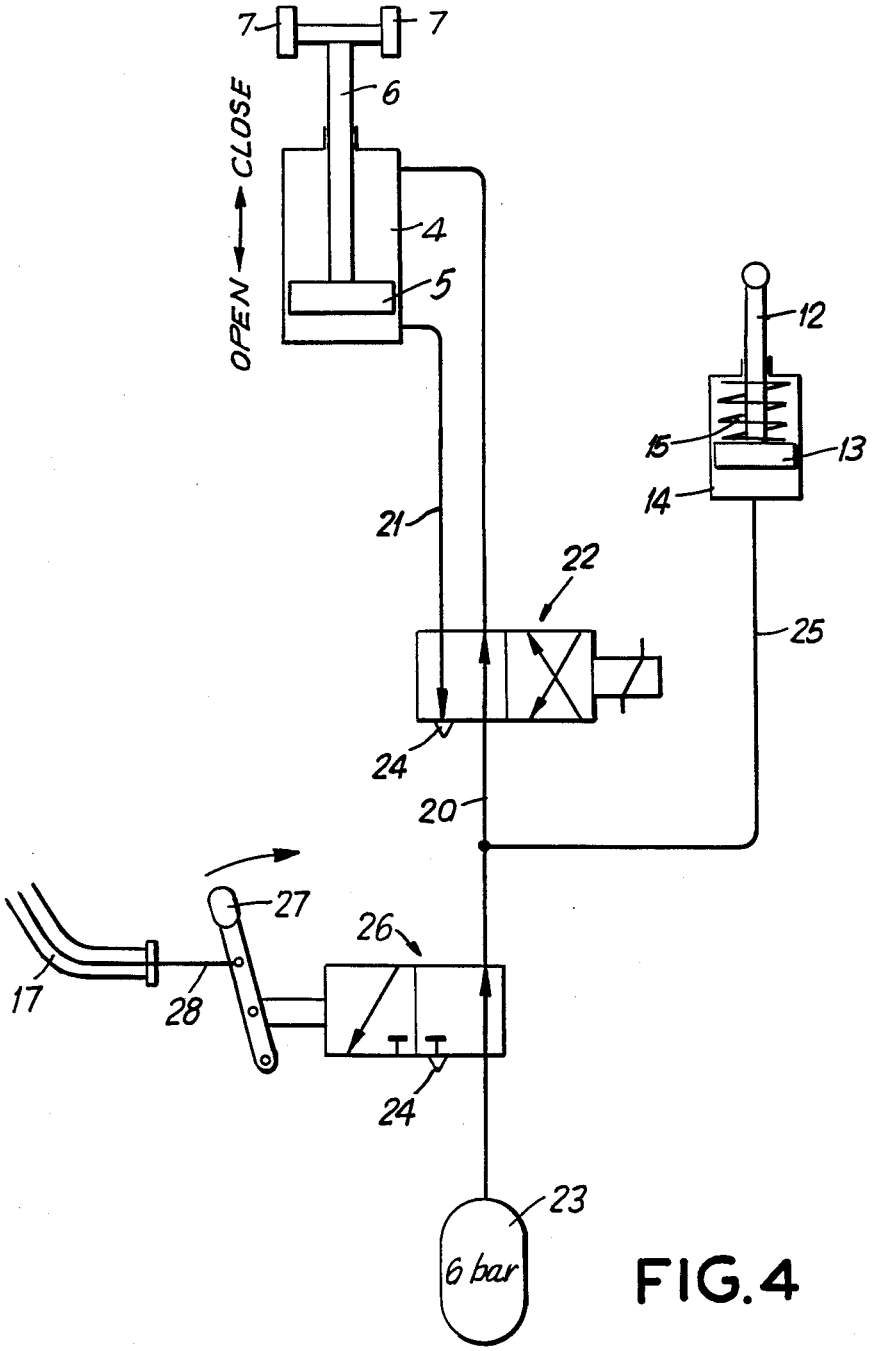

FIG. 1 shows the elevation of a door drive according to the invention in vertical section, FIGS. 2 and 3 show a cross-section, wherein in FIG. 2 the blocking lever is depicted in its effective and in FIG. 3 in its ineffective position, and FIG. 4 shows a control circuit arrangement.

A shaft 2 is supported in a console 1, which shaft can be rotated by means of a helical gear box 3. Below the helical gear box a power cylinder 4 with a double-acting piston 5 together with inlet and outlet flow means for the pressure medium is provided. The piston rod 6 is equipped with a pair of rollers 7, guided in slots 8 of the helical gear box 3. Thus the axial motion of the double-acting piston 5 is converted into a rotary motion of the shaft 2, which embraces the pair of rollers 7 by means of axial slots.

If the end of the slots 8 is designed to be inclined with respect to the rotational axis, so that no self-locking feature exists, then one runs the danger, that in case of pressure loss the double-acting piston 5 is no longer secured in its upper position and that at least in case of a load acting upon the door no resistance can be opposed to a rotational movement of the shaft 2. In order to prevent this, an angular blocking lever 10 is pivotably supported at a console 9, which in its non-depicted blocking position grips beneath a roller 11, which is supported at the piston rod 6 coaxially with the roller pair 7. A piston rod 12 of piston 13 is linked to the blocking lever 10, said piston 13 sliding in a power cylinder 14 and being acted upon on one side by the same pressure medium as the double acting piston 5. A pressure spring 15 is inserted between the one front face of the power cylinder 14 and the pistons 13. The power cylinder 14 is pivotably supported at a console 16. The blocking lever 10 is rigidly connected by means of a shaft with the lever **10*a*, acted upon by a Bowden cable 17, which enables a manual pivoting of the blocking lever 10 out of its blocking position counter to the force of a spiral spring 18. The entire arrangement is covered by a casing 19**.

According to FIG. 4 the power cylinder 4 is connected with a control valve 22 by means of lines 20, 21, one side of said control valve being connected to a pressure source 23. An additional line 24 leads back into the pressure means reservoir. A branch line 25 leads from the pressure line to the power cylinder 14. Furthermore, a valve 26 is interposed in the pressure line which can be actuated by means of a hand lever 27. It selectively connects the pressure source 23 with the valve 22 or the pressure line with the return flow. The one end 28 of the Bowden cable 17 is fastened to the hand lever 27.

The power cylinder 4 can be set by means of the valve 22 to perform an opening or closing motion. In the closed position the double-acting piston 5 is in its top end position and is maintained in this position by the pressure medium. The power cylinder 14 is always connected to the pressure line, so that the piston 13 is in its end position compressing the spring 15, in which end position it holds the blocking lever 10 out of its blocking position. The hand lever 27 which together with the Bowden cable 17 and the valve 26 constitutes an emergency device, is in that position in which the valve 26 connects the pressure source 23 with the valve 22. If leakage occurs at some point of the lines which are under pressure and if therefore the pressure drops, then to begin with the piston 13 is pressed into the power cylinder 4 under the action of the spring 15, whereby at first the leakage amount is compensated. Herein the blocking lever 10 was brought into its blocking position by the piston rod 12, in which blocking position said blocking lever grips below roller 11 (FIG. 2). In case of additional escape of the pressure means the power piston 4 loses the pressure acting upon it. In spite of that the door cannot open either of itself or when subjected to a load. An opening of the door is however temporarily possible, if the Bowden cable 17 is actuated by the hand lever 27. Upon release of the lever 27 the blocking lever 10 returns into its blocking position.

If the door is to be opened by means of the emergency device, then the hand lever 27 is actuated wherein the pressure line is connected with the return line 24 through the valve 27 and simultaneously the Bowden cable is also actuated, so that the blocking lever is maintained in its open position, in spite of the fact that not only the power cylinder 4 but rather also the power cylinder 14 remain without the effect of pressure.

It does not matter from which segment of the pressure line 20 the branch line 25 emanates.

I claim:

1. A device for securing a door in a closed position, the door being supported by a spindle secured in axial direction and the door being connected to a pneumatic or hydraulic drive for opening and closing the door, the drive comprising a double-acting piston and a pressure line for supplying a pressure medium, the pressure medium acting on the piston, a first piston rod and a helical gear assembly for converting the linear motion of the piston into a rotary motion of the spindle, a blocking lever mounted so as to be pivotable about a stationary axis, the blocking lever being movable between a closed end position and an open end position, a member connected to the piston being movable along a path of movement, the blocking lever being in the path of movement of the member in the open end position thereof and the blocking lever being away from the path of movement of the member in the closed end position thereof, a single-acting power cylinder with a second piston rod, the single-acting power cylinder being connected exclusively to the pressure line of the drive, the blocking lever being connected to the second piston rod in an articulated manner, the blocking lever being movable in the open end position against the force of a spring when pressure medium is admitted to the single-acting power cylinder.

2. The device according to claim 1, wherein the pneumatic or hydraulic drive is connected directly to the pressure line of the pressure medium through a control valve, the power cylinder actuating the blocking lever also being connected to the pressure line parallel to the control valve.

3. The device according to claim 2, comprising a three-way valve for the blocking lever provided in the pressure line for the drive and the power cylinder, the three-way valve being actuatable manually by means of a lever which is connected through a Bowden cable to the blocking lever, whereby simultaneously the blocking lever is moved into its open end position.

* * * * *